US012377314B1

(12) United States Patent
Braley

(10) Patent No.: US 12,377,314 B1
(45) Date of Patent: Aug. 5, 2025

(54) FLOOR-MOUNTED ANKLE REHAB EXERCISE DEVICE

(71) Applicant: Nicholas William Braley, Winston-Salem, NC (US)

(72) Inventor: Nicholas William Braley, Winston-Salem, NC (US)

( * ) Notice: Subject to any disclaimer, the term of this patent is extended or adjusted under 35 U.S.C. 154(b) by 101 days.

(21) Appl. No.: 18/503,793

(22) Filed: Nov. 7, 2023

Related U.S. Application Data

(60) Provisional application No. 63/447,103, filed on Feb. 21, 2023.

(51) Int. Cl.

| | |
|---|---|
| ***A63B 23/08*** | (2006.01) |
| ***A63B 21/00*** | (2006.01) |
| ***A63B 21/04*** | (2006.01) |
| ***A63B 21/055*** | (2006.01) |
| ***A63B 23/035*** | (2006.01) |

(52) U.S. Cl.
CPC ..... *A63B 23/08* (2013.01); *A63B 21/0442* (2013.01); *A63B 21/0552* (2013.01); *A63B 21/4033* (2015.10); *A63B 23/03508* (2013.01)

(58) Field of Classification Search
CPC . A63B 23/08; A63B 21/0442; A63B 21/0552; A63B 21/4033; A63B 23/03508
See application file for complete search history.

(56) References Cited

U.S. PATENT DOCUMENTS

| | | | | |
|---|---|---|---|---|
| 5,178,596 | A * | 1/1993 | McIntire | A63B 21/0552 482/125 |
| 5,417,636 | A * | 5/1995 | Havens | A63B 21/0552 482/145 |
| 5,451,194 | A * | 9/1995 | Harrigan | A63B 69/0022 482/70 |
| D383,607 | S | 9/1997 | Whitlock | |
| 6,283,897 | B1 * | 9/2001 | Patton | A63B 21/055 482/79 |
| 7,217,228 | B2 | 5/2007 | Marquez | |
| 7,410,450 | B1 * | 8/2008 | Paulding | A63B 21/1609 482/121 |
| 7,431,681 | B1 * | 10/2008 | St. Cyr | A63B 21/0552 482/121 |
| 7,794,367 | B2 * | 9/2010 | Hall | A63B 21/4015 482/79 |
| D700,792 | S | 3/2014 | Melton | |

(Continued)

FOREIGN PATENT DOCUMENTS

WO 2014035976 3/2014

*Primary Examiner* — Andrew S Lo
(74) *Attorney, Agent, or Firm* — Kyle A. Fletcher, Esq.

(57) ABSTRACT

The floor ankle rehabilitation exercise device is a therapeutic device. The floor ankle rehabilitation exercise device is adapted for use in the rehabilitation of an ankle of a patient. The floor ankle rehabilitation exercise device is a strength training device. The floor ankle rehabilitation exercise device allows the patient to perform isotonic exercises intended to strengthen the ankle of the patient. The floor ankle rehabilitation exercise device incorporates a disk structure, a plurality of stanchion structures, and a resistance band. The plurality of stanchion structures attach to the disk structure. The resistance band attaches to the plurality of stanchion structures. The resistance band provides a counterforce for the isotonic exercises performed by the patient.

10 Claims, 5 Drawing Sheets

(56) References Cited

U.S. PATENT DOCUMENTS

| | | | | |
|---|---|---|---|---|
| 8,992,389 | B2 * | 3/2015 | Abel | A63B 23/03541 482/51 |
| 9,162,106 | B1 | 10/2015 | Scheiman | |
| 9,616,275 | B1 | 4/2017 | Rogoff | |
| 9,737,748 | B1 * | 8/2017 | Chapman | A63B 21/1681 |
| 9,821,184 | B1 * | 11/2017 | Chapman | A61H 1/024 |
| 10,010,739 | B2 | 7/2018 | Chapma | |
| 10,238,525 | B2 | 3/2019 | Gold | |
| 10,315,065 | B1 * | 6/2019 | Soba | A63B 21/151 |
| 10,434,365 | B2 | 10/2019 | Mack | |
| 11,260,262 | B2 | 3/2022 | Oltorik | |
| 2011/0251033 | A1 * | 10/2011 | Blancher | A63B 22/16 482/123 |
| 2012/0115692 | A1 * | 5/2012 | Bussen | A63B 23/0355 482/130 |
| 2016/0016029 | A1 * | 1/2016 | Savioli | A63B 21/16 482/92 |
| 2016/0067540 | A1 * | 3/2016 | Dill | A63B 23/1245 482/129 |
| 2017/0354839 | A1 * | 12/2017 | Reque | A63B 21/4035 |
| 2020/0261761 | A1 * | 8/2020 | Chapman | A63B 23/03508 |
| 2021/0121726 | A1 * | 4/2021 | Potapov | A63B 21/4037 |
| 2021/0299514 | A1 | 9/2021 | Tak | |

* cited by examiner

FLOOR-MOUNTED ANKLE REHAB EXERCISE DEVICE

CROSS REFERENCES TO RELATED APPLICATIONS

This non-provisional application claims priority under 35 USC 119(e) to United States provisional application U.S. 63/447,103 filed on Feb. 21, 2023 by the inventor: Nicholas William Braley. This non-provisional application claims United States provisional application U.S. 63/447,103 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of exercising apparatus for developing or strengthening the muscles or joints of the body by working against a counterforce, with or without measuring devices. (A63B21/02)

SUMMARY OF INVENTION

The floor ankle rehabilitation exercise device is a therapeutic device. The floor ankle rehabilitation exercise device is adapted for use in the rehabilitation of an ankle of a patient. The floor ankle rehabilitation exercise device is a strength training device. The floor ankle rehabilitation exercise device allows the patient to perform isotonic exercises intended to strengthen the ankle of the patient. The floor ankle rehabilitation exercise device comprises a disk structure, a plurality of stanchion structures, and a resistance band. The plurality of stanchion structures attach to the disk structure. The resistance band attaches to the plurality of stanchion structures. The resistance band provides a counterforce for the isotonic exercises performed by the patient.

These together with additional objects, features and advantages of the floor ankle rehabilitation exercise device will be readily apparent to those of ordinary skill in the art upon reading the following detailed description of the presently preferred, but nonetheless illustrative, embodiments when taken in conjunction with the accompanying drawings.

In this respect, before explaining the current embodiments of the floor ankle rehabilitation exercise device in detail, it is to be understood that the floor ankle rehabilitation exercise device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the floor ankle rehabilitation exercise device.

It is therefore important that the claims be regarded as including such equivalent construction insofar as they do not depart from the spirit and scope of the floor ankle rehabilitation exercise device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
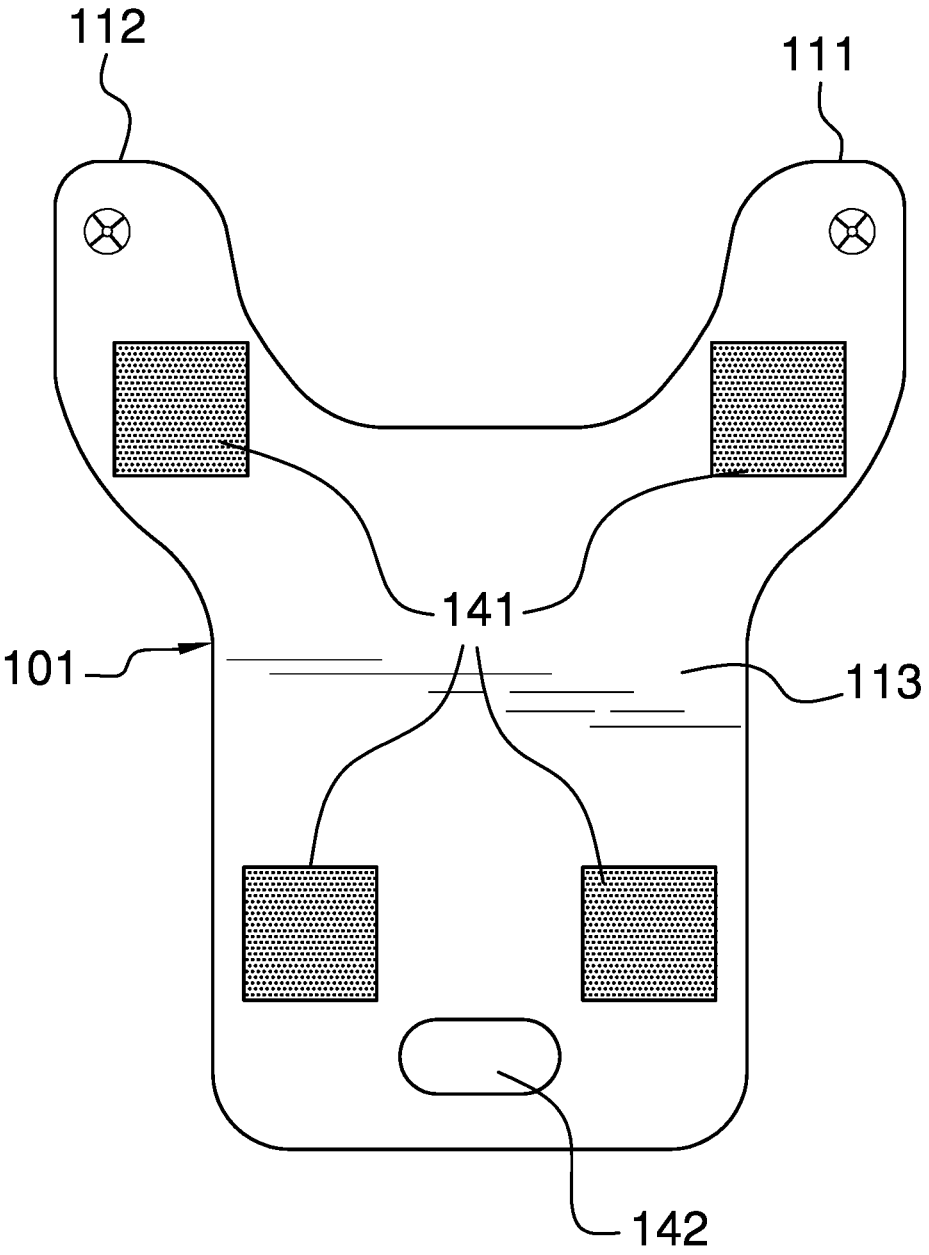
FIG. 1 is a bottom view of an embodiment of the disclosure.
Figure 2:
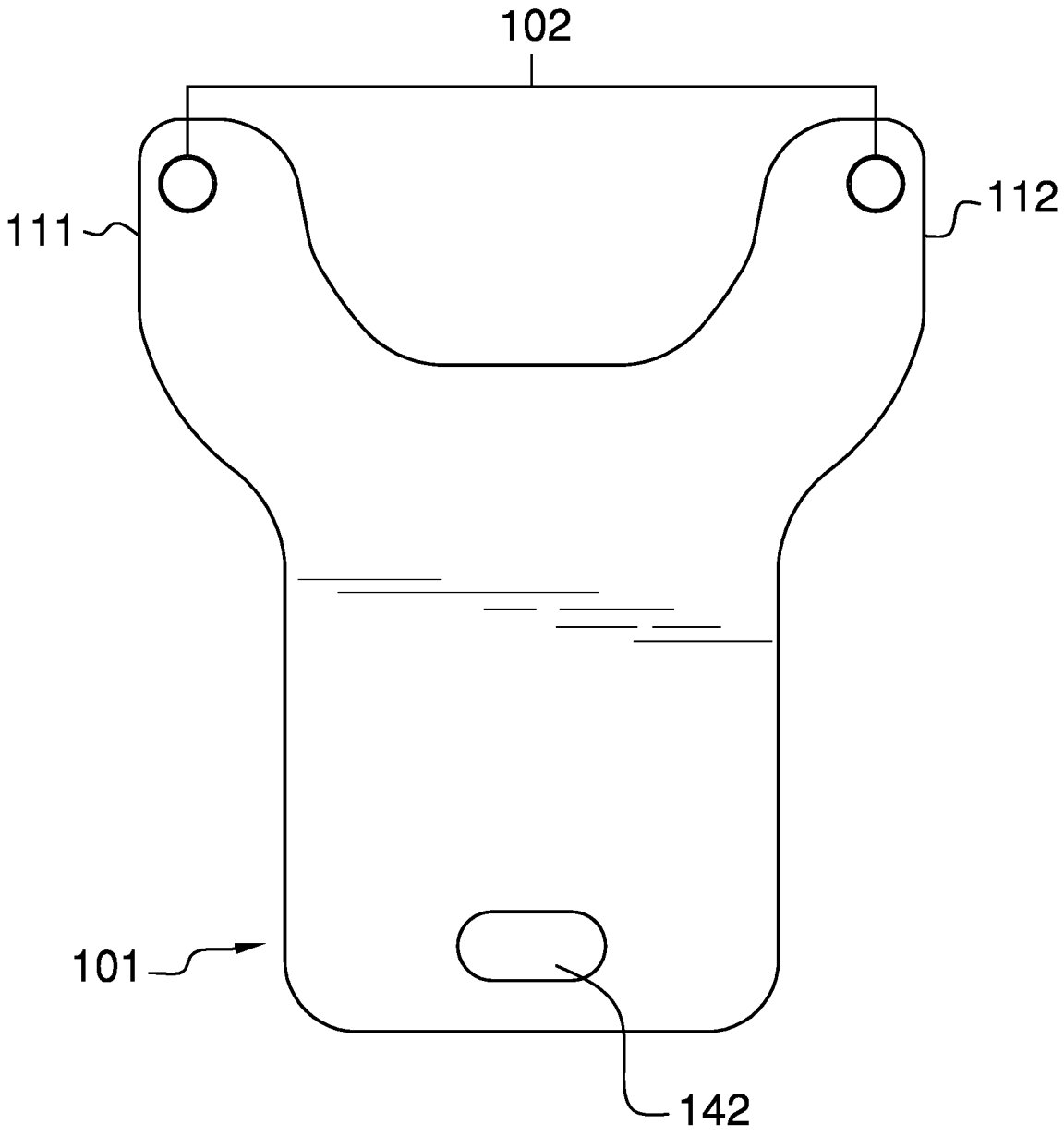
FIG. 2 is a top view of an embodiment of the disclosure.
Figure 3:
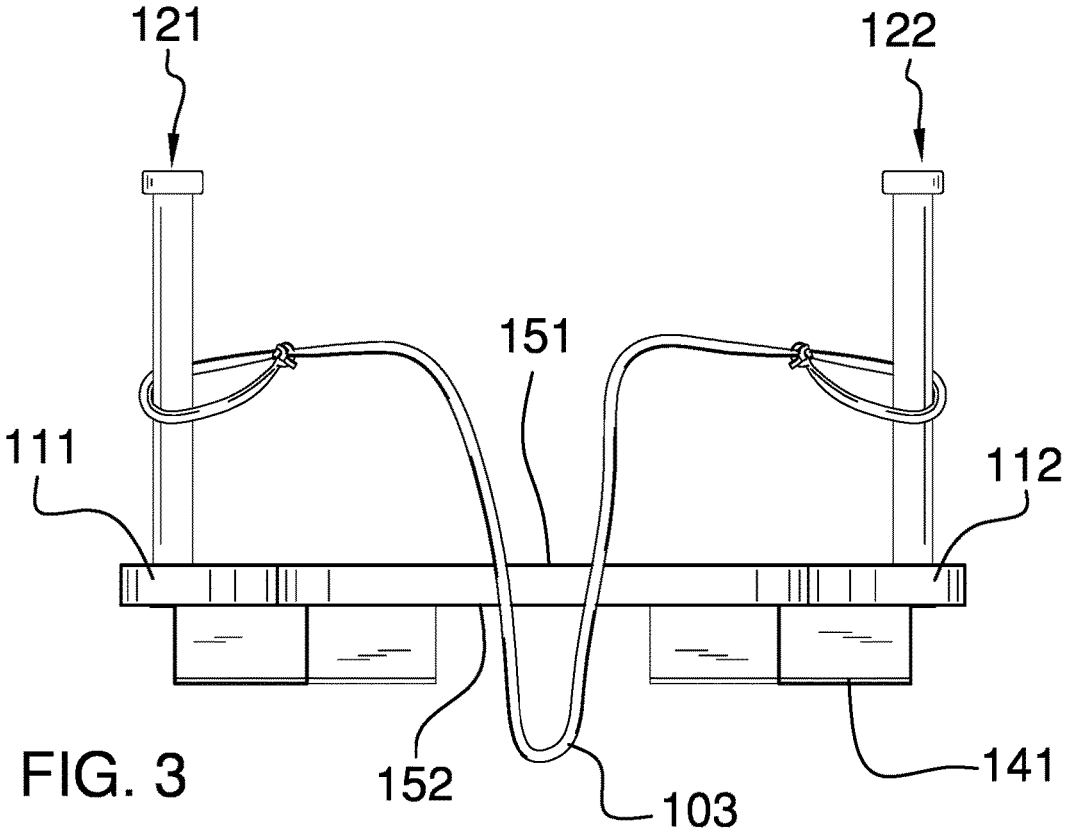
FIG. 3 is a side view of an embodiment of the disclosure.
Figure 4:
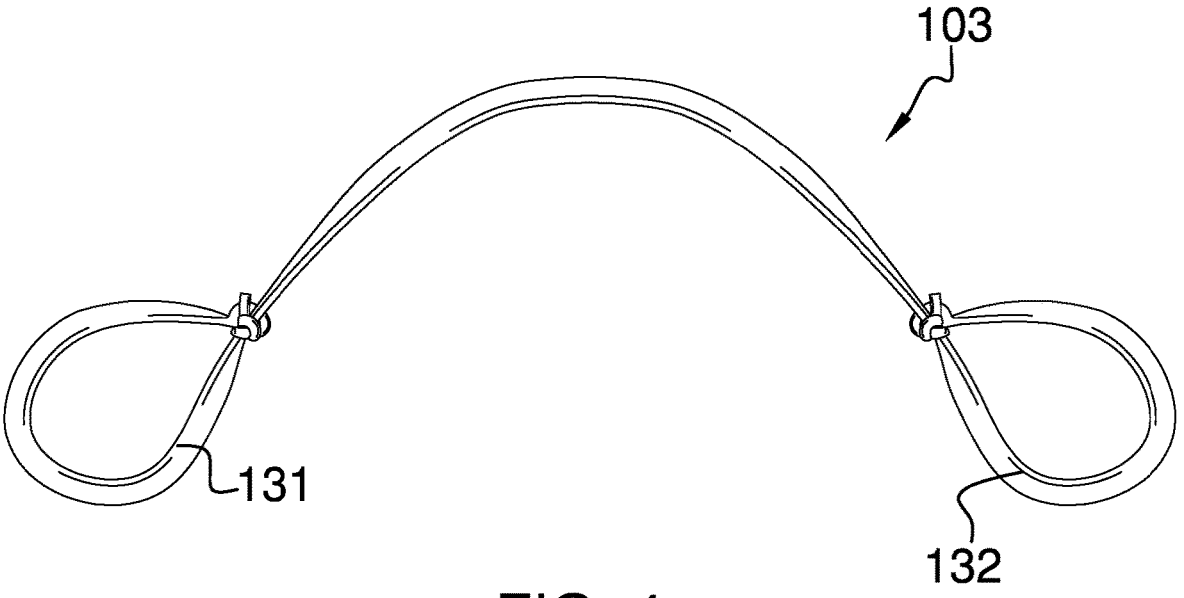
FIG. 4 is a detail view of an embodiment of the disclosure.
Figure 5:
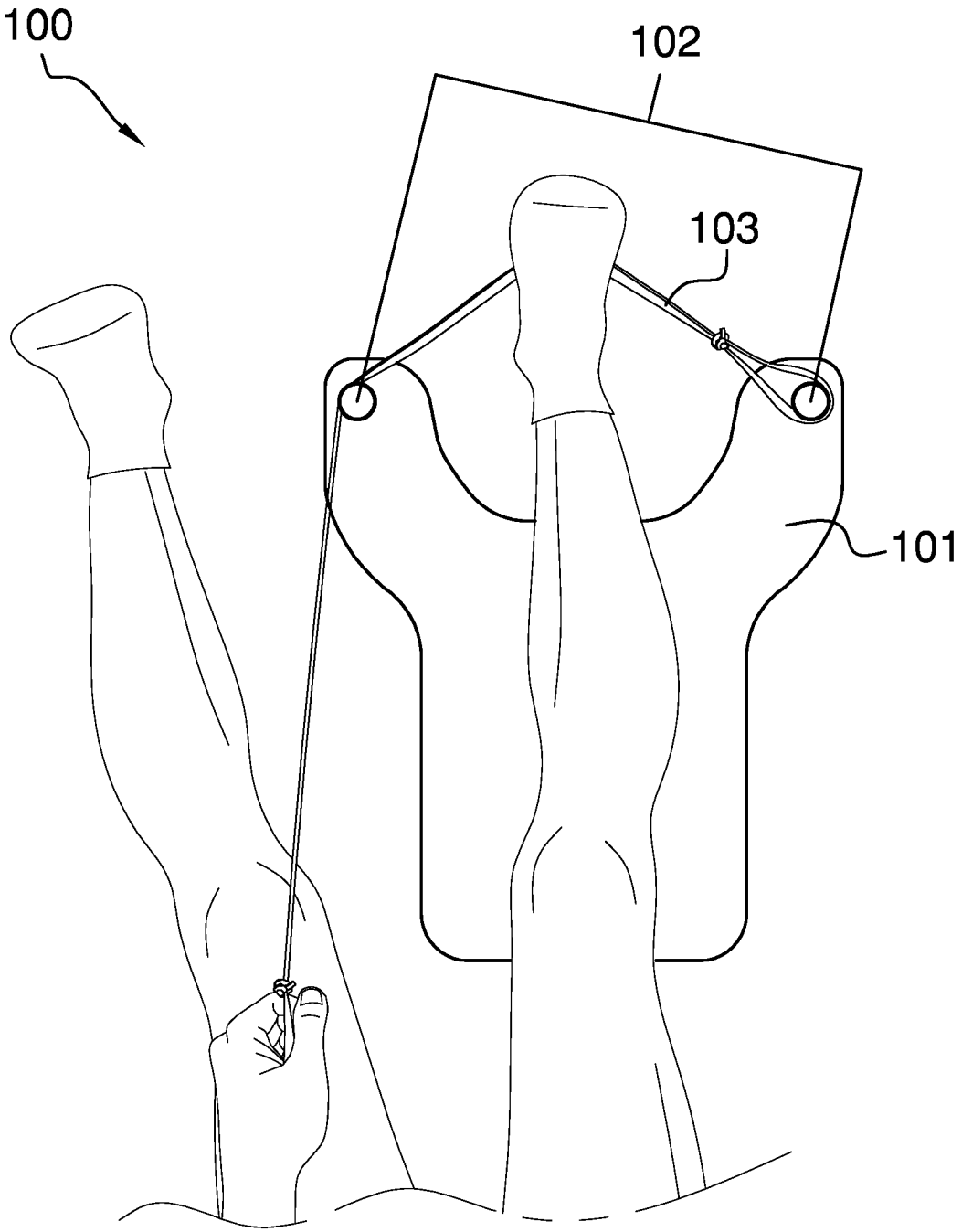
FIG. 5 is an in-use view of an embodiment of the disclosure.
Figure 6:
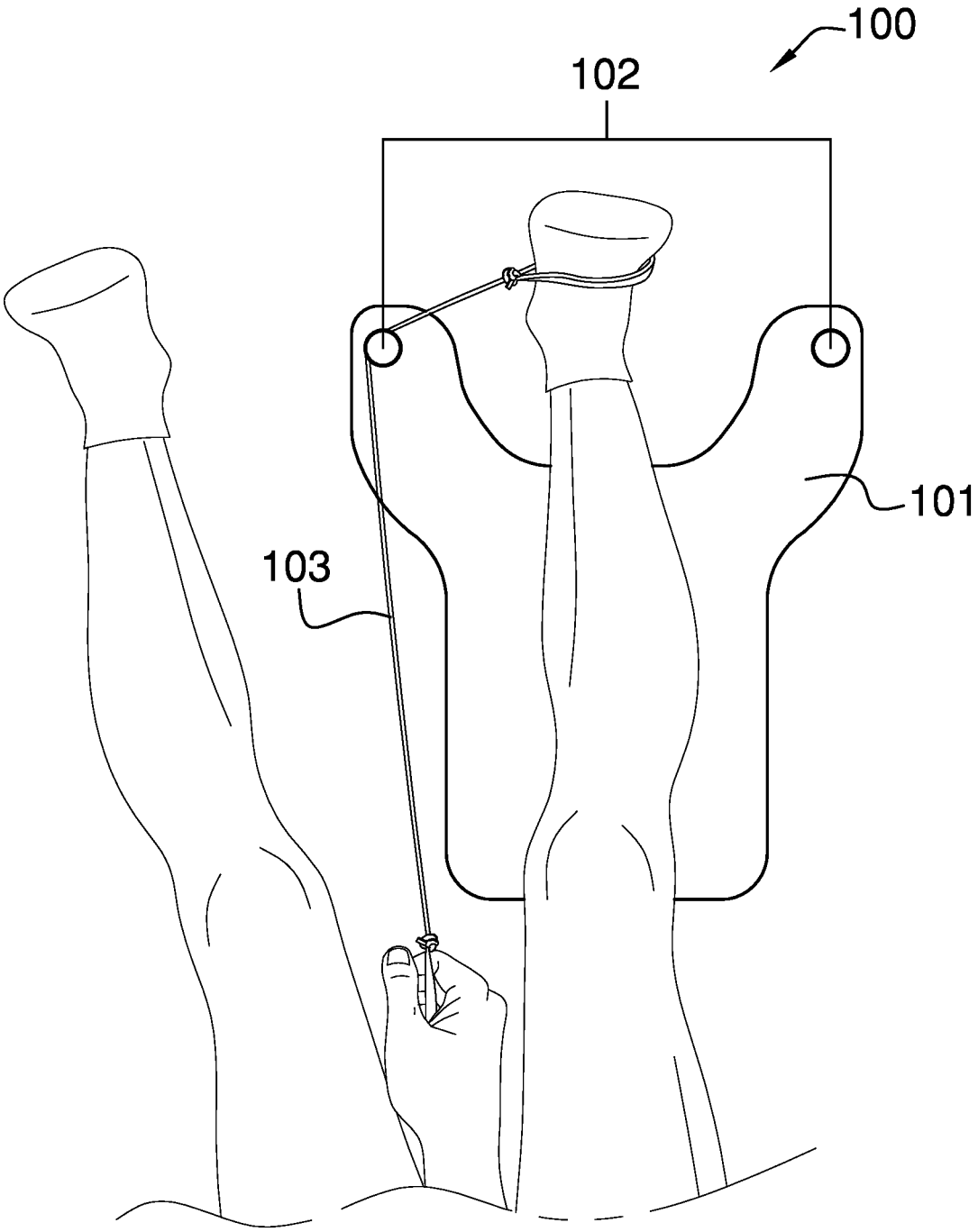
FIG. 6 is an in-use view of an embodiment of the disclosure.

Detailed reference will now be made to one or more potential embodiments of the disclosure, which are illustrated in FIGS. 1 through 6.

The floor ankle rehabilitation exercise device 100 (hereinafter invention) is a therapeutic device. The invention 100 is adapted for use in the rehabilitation of an ankle of a patient. The invention 100 is a strength training device. The invention 100 allows the patient to perform isotonic exercises intended to strengthen the ankle of the patient. The invention 100 comprises a disk structure 101, a plurality of stanchion structures 102, and a resistance band structure 103. The plurality of stanchion structures 102 attach to the disk structure 101. The resistance band structure 103 attaches to the plurality of stanchion structures 102. The resistance band structure 103 provides a counterforce for the isotonic exercises performed by the patient.

The disk structure 101 is a prism shaped structure. The disk structure 101 has a disk shape. The disk structure 101 forms an elevated horizontally oriented surface. The disk structure 101 rests on the floor. The patient rests on the disk structure 101 during exercise. The plurality of stanchion structures 102 removably attach to the disk structure 101. The disk structure 101 has formed as a Y-shaped structure.

The components of the Y-shaped structure of the disk structure as assembled to form a lateral disk shape.

The disk structure 101 comprises a first arm 111, a second arm 112, and a base plate 113. The first arm 111, the second arm 112, and the base plate 113 are joined to form the lateral disk structure of the disk structure 101. The disk structure 101 further comprises a fastening device 141, a grip structure 142, a superior face 151, and an inferior face 152.

The superior face 151 is a congruent end of the irregular disk shape of the disk structure 101. The superior face 151 is the congruent end of the disk structure 101 that is distal from the floor. The inferior face 152 is a congruent end of the irregular disk shape of the disk structure 101. The inferior face 152 is the congruent end of the disk structure 101 that rests on the floor. The inferior face 152 is the congruent end of the disk structure 101 that is distal from the superior face 151.

The first arm 111 is a disk shaped structure. The first arm 111 is a rigid structure. The first arm 111 attaches to the base plate 113 to form a lateral disk structure. The first arm 111 forms a first arm 111 of the Y-shaped structure of the disk structure 101. The first arm 111 receives a stanchion structure selected from the plurality of stanchion structures 102.

The second arm 112 is a disk shaped structure. The second arm 112 is a rigid structure. The second arm 112 attaches to the base plate 113 to form a lateral disk structure within the disk structure 101. The second arm 112 forms a second arm 112 of the Y-shaped structure of the disk structure 101. The second arm 112 receives a stanchion structure selected from the plurality of stanchion structures 102.

The base plate 113 is a disk shaped structure. The base plate 113 is a rigid structure. The base plate 113 forms the base structure of the Y-shaped structure of the disk structure 101. The base plate 113 attaches to the first arm 111 to form a lateral disk structure within the disk structure 101. The base plate 113 attaches to the second arm 112 to form a lateral disk structure within the disk structure 101.

The fastening device 141 is a mechanical device. The fastening device 141 secures the inferior face 152 of the disk structure 101 to the floor. The fastening device 141 prevents the position of the disk structure 101 from shifting during use. In the first potential embodiment of the disclosure, the fastening device 141 comprises a plurality of non-skid structures. The grip structure 142 forms a handle used to carry the invention 100. The grip structure 142 is a negative space that is formed through the congruent ends of the disk shape of the base plate 113 of the disk structure 101.

Each stanchion structure selected from the plurality of stanchion structures 102 is a mechanical structure. Each selected stanchion structure is a prism shaped structure. Each selected stanchion structure attaches to an arm selected from the group consisting of: a) the first arm 111; and, b) the second arm 112. Each selected stanchion structure secures the resistance band 103 to the disk structure 101 such that the resistance band 103 can be reached by the ankle of the patient. The resistance band 103 removably attaches to each stanchion structure selected from the plurality of stanchion structures 102. Each stanchion structure selected from the plurality of stanchion structures 102 secures an end of the resistance band 103 into a fixed position such that the resistance band 103 can be deformed and relaxed by the ankle of the patient.

The plurality of stanchion structures 102 comprises a first stanchion structure 121 and a second stanchion structure 122.

The first stanchion structure 121 is a prism shaped structure. The first stanchion structure 121 is a rigid structure. The first stanchion structure 121 forms a first anchor point for the resistance band 103. The resistance band 103 anchors to the first stanchion structure 121. The first stanchion structure 121 attaches to the superior congruent end of the disk structure of the first arm 111. The first stanchion structure 121 attaches to the superior congruent end of the disk structure of the first arm 111 to form a composite prism structure.

The second stanchion structure 122 is a prism shaped structure. The second stanchion structure 122 is a rigid structure. The second stanchion structure 122 forms a second anchor point for the resistance band 103. The resistance band 103 anchors to the second stanchion structure 122. The second stanchion structure 122 attaches to the superior face 141 of the disk structure of the second arm 112. The second stanchion structure 122 attaches to superior face 141 of the disk structure of the first arm 112 to form a composite prism structure.

The resistance band 103 is an elastic band. The resistance band 103 secures the ankle of the patient to an stanchion structure selected from the plurality of stanchion structures 102. The deformation of the resistance band 103 forms a counterforce that resists the motion of the ankle of the patient. The resistance band 103 comprises a first band loop and a second band loop 192. The first band loop 191 is a ring shaped structure that attaches to an end of the resistance band 103. The first band loop 191 slips over the first stanchion structure 121 of the first stanchion structure 121. The second band loop 192 is a ring shaped structure that attaches to an end of the resistance band 103. The second band loop 192 slips over the second stanchion structure 122 of the second stanchion structure 122.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Ankle: As used in this disclosure, the ankle is the joint in the human body that joins the foot to the leg. The ankle comprises the lateral malleolus region of the fibula, the medial malleolus region of the tibia, and the talus. The talus attaches the lateral malleolus region of the fibula and the medial malleolus region of the tibia to the hindfoot region of the foot.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Band: As used in this disclosure, an elastic band is a loop of textile that is formed using elastic material that can stretched. Alternatively, the elastic band can be a sheeting that is formed from latex, spandex, or an elastic plastic film that can be stretched.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exercise: As used in this disclosure, to exercise is a verb that refers to one or more physical activities that cause an individual to exert their muscles and organs such that the performance of the individual in the one or more physical activities will improve over a period of time. Each of the one or more physical activities are referred to as an exercise. Exercises are commonly classified as endurance exercises and strength training exercises. An endurance exercise focuses on improving the stamina and cardiovascular health of the individual. Strength exercises focus on improving the force, power, or work that can be generated from the muscles of the individual. Strength exercises are commonly classified as isometric exercises and isotonic exercises. An isometric exercise involves a motion that contracts the muscles of the individual without requiring the rotation of a joint of the individual. An isotonic exercise involves a motion that requires the rotation of a joint during the contraction of the muscle of the individual.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Floor: As used in this disclosure a floor refers the inferior horizontal supporting surface of a chamber. An individual stands on a floor. Within a structure, the floor is often referred to as the ground.

Foot: As used in this disclosure, the foot refers to the portion of the leg that is below the ankle. Within this disclosure, the foot is further defined with a forefoot, a midfoot, a hindfoot, and a sole. The forefoot is the region of the foot is the anterior portion of the foot within which the phalanges and the metatarsals bones are located. The midfoot is the region of the foot within which the navicular, cuboid, and cuneiform bones are located. The hindfoot is the region of the foot that is posterior to the midfoot. The sole refers to the inferior surfaces of the foot located underneath the forefoot, the midfoot, and the hindfoot. The human foot further comprises five toes formed at the distal end of the forefoot.

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Grip: As used in this disclosure, a grip is an accommodation formed on or within an object that allows the object to be grasped or manipulated by a hand.

Ground: As used in this disclosure, the ground is a solid supporting surface formed by the Earth. The term level ground means that the supporting surface formed by the ground is roughly perpendicular to the force of gravity. The term underground refers to an object being underneath the superior surface of the ground.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Jib: As used in this disclosure, a jib is a beam structure that: 1) is mounted with a free end in the manner of a cantilever; and, 2) suspends a load at the free end of the jib. In multicomponent beam structures, such as with a crane, the jib is the sub-structure that physically suspends the load.

Joint: As used in this disclosure, a joint refers to the attachment of a first bone of a body to a second bone of the body such that the first bone is able to rotate relative to the second joint.

Keyhole: As used in this disclosure, a keyhole refers to a negative space formed through a surface. The keyhole has a characteristic shape of a rectangle with a circle located at the narrow end of the rectangle. The diameter of the circle is greater than the span of the narrow end of the rectangle. The keyhole is used to secure an object to the surface. Specifically, the object has a disk shape mounted on an extension structure. The diameter of the disk is less than the diameter of the circle such that the disk will insert through the circle. The diameter of the disk is greater than the span of the narrow end of the rectangle such when the disk is slid underneath the rectangle the disk will not pass through the rectangle thereby securing the object to the surface. The size of the extension structure is selected such that the extension will slide into the rectangle. Use diameter, extension structure, disk, and cylinder.

Lateral Disk Structure: As used in this disclosure, a lateral disk structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Non-Skid Structure: As used in this disclosure, a non-skid structure is a mechanical structure that attaches to an object such that the object is inhibited from sliding along the surface upon which the object is resting.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Patient: As used in this disclosure, a patient is a person who is designated to receive a medical treatment, therapy, or service. The term patient may be extended to an animal when used within the context of the animal receiving veterinary treatment or services.

Perimeter: As used in this disclosure, a perimeter is one or more curved or straight lines that bounds an enclosed area on a plane or surface. The perimeter of a circle is commonly referred to as a circumference.

Platform: As used in this disclosure, a platform is an elevated horizontal surface that forms a load path to support objects placed on the superior surface of the platform.

Primary Shape: As used in this disclosure, the primary shape refers to a description of the rough overall geometric shape of an object that is assembled from multiple components or surfaces. Use Roughly Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Reach: As used in this disclosure, reach refers to a span of distance between any two objects.

Resistance: As used in this disclosure, resistance refers to a structure that opposes the desired motion or desired acceleration of an object.

Resistance Band: As used in this disclosure, a resistance band is an elastic band that is used to provide resistance during strength training exercises.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object.

Therapeutic: As used in this disclosure, therapeutic is an adjective that refers to a medical, ameliorative, or hygienic substance, process, procedure, or device.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A floor ankle rehabilitation exercise device comprising a disk structure, a plurality of stanchion structures, and a resistance band structure;

wherein the plurality of stanchion structures attach to the disk structure;

wherein the resistance band structure attaches to the plurality of stanchion structures;

wherein the floor ankle rehabilitation exercise device is adapted for use in the rehabilitation of an ankle of a patient;

wherein the disk structure is adapted to form an elevated horizontally oriented surface that rests on the floor such that the patient rests on the disk structure during exercise;

wherein the disk structure comprises a first arm, a second arm, and a base plate;

wherein the first arm, the second arm, and the base plate are joined to form a lateral disk structure of the disk structure;

wherein the disk structure further comprises a fastening device, a grip structure, a superior face, and an inferior face;

wherein the superior face is a congruent end of an irregular disk shape of the disk structure;

wherein the superior face is the congruent end of the disk structure that is distal from the floor;

wherein the inferior face is a congruent end of the irregular disk shape of the disk structure;

wherein the inferior face is the congruent end of the disk structure that rests on the floor;

wherein the inferior face is the congruent end of the disk structure that is distal from the superior face.

2. The floor ankle rehabilitation exercise device according to claim 1 wherein the floor ankle rehabilitation exercise device is a therapeutic device;

wherein the floor ankle rehabilitation exercise device is a strength training device;

wherein the floor ankle rehabilitation exercise device allows the patient to perform isotonic exercises intended to strengthen the ankle of the patient;

wherein the resistance band structure provides a counter-force for the isotonic exercises performed by the patient.

3. The floor ankle rehabilitation exercise device according to claim 2 wherein the disk structure has a disk shape;

wherein the plurality of stanchion structures removably attach to the disk structure;

wherein the disk structure has formed as a y-shaped structure;

wherein the components of the y-shaped structure of the disk structure as assembled to form a lateral disk shape.

4. The floor ankle rehabilitation exercise device according to claim 3 wherein each stanchion structure selected from the plurality of stanchion structures is a mechanical structure;

wherein each selected stanchion structure attaches to an arm selected from the group consisting of: a) the first arm; and, b) the second arm;

wherein each selected stanchion structure secures the resistance band to the disk structure such that the resistance band can be reached by the ankle of the patient;

wherein the resistance band removably attaches to each stanchion structure selected from the plurality of stanchion structures;

wherein each stanchion structure selected from the plurality of stanchion structures secures an end of the resistance band into a fixed position such that the resistance band can be deformed and relaxed by the ankle of the patient.

5. The floor ankle rehabilitation exercise device according to claim 4 wherein the resistance band is an elastic band;

wherein the resistance band secures the ankle of the patient to a stanchion structure selected from the plurality of stanchion structures;

wherein the deformation of the resistance band forms a counterforce that resists the motion of the ankle of the patient.

6. The floor ankle rehabilitation exercise device according to claim 5 wherein the first arm is a disk shaped structure;

wherein the first arm is a rigid structure;

wherein the first arm attaches to the base plate to form a lateral disk structure;

wherein the first arm forms a first arm of the y-shaped structure of the disk structure;

wherein the first arm receives a stanchion structure selected from the plurality of stanchion structures;

wherein the second arm is a disk shaped structure;

wherein the second arm is a rigid structure;

wherein the second arm attaches to the base plate to form a lateral disk structure within the disk structure;

wherein the second arm forms a second arm of the y-shaped structure of the disk structure;

wherein the second arm receives a stanchion structure selected from the plurality of stanchion structures.

7. The floor ankle rehabilitation exercise device according to claim 6 wherein the base plate is a disk shaped structure;

wherein the base plate is a rigid structure;

wherein the base plate forms the base structure of the y-shaped structure of the disk structure;

wherein the base plate attaches to the first arm to form a lateral disk structure within the disk structure;

wherein the base plate attaches to the second arm to form a lateral disk structure within the disk structure.

8. The floor ankle rehabilitation exercise device according to claim 7 wherein the fastening device is a mechanical device;

wherein the fastening device secures the inferior face of the disk structure to the floor;

wherein the fastening device prevents the position of the disk structure from shifting during use;

wherein the grip structure forms a handle used to carry the floor ankle rehabilitation exercise device;

wherein the grip structure is a negative space that is formed through the congruent ends of the disk shape of the base plate of the disk structure.

9. The floor ankle rehabilitation exercise device according to claim 8 wherein the plurality of stanchion structures comprises a first stanchion structure and a second stanchion structure;

wherein the first stanchion structure is a rigid structure;

wherein the first stanchion structure forms a first anchor point for the resistance band;

wherein the resistance band anchors to the first stanchion structure;

wherein the first stanchion structure attaches to the superior congruent end of the disk structure of the first arm;

wherein the first stanchion structure attaches to the superior congruent end of the disk structure of the first arm to form a composite structure;

wherein the second stanchion structure is a rigid structure;

wherein the second stanchion structure forms a second anchor point for the resistance band;

wherein the resistance band anchors to the second stanchion structure;

wherein the second stanchion structure attaches to the superior face of the disk structure of the second arm;

wherein the second stanchion structure attaches to superior face of the disk structure of the first arm to form a composite structure.

10. The floor ankle rehabilitation exercise device according to claim 9 wherein the resistance band comprises a first band loop and a second band loop;

wherein the first band loop is a ring shaped structure that attaches to an end of the resistance band;

wherein the first band loop slips over the first stanchion structure of the first stanchion structure;

wherein the second band loop is a ring shaped structure that attaches to an end of the resistance band;

wherein the second band loop slips over the second stanchion structure of the second stanchion structure.

* * * * *